US007316050B2

(12) United States Patent
Worwag

(10) Patent No.: US 7,316,050 B2
(45) Date of Patent: Jan. 8, 2008

(54) VACUUM CLEANING TOOL HAVING AN EXCHANGEABLE ATTACHMENT

(75) Inventor: Peter Worwag, Staad (CH)

(73) Assignee: Düpro AG, Romanshorn (CH)

( * ) Notice: Subject to any disclaimer, the term of this patent is extended or adjusted under 35 U.S.C. 154(b) by 937 days.

(21) Appl. No.: 10/707,192

(22) Filed: Nov. 26, 2003

(65) Prior Publication Data

US 2004/0103496 A1 Jun. 3, 2004

(30) Foreign Application Priority Data

Nov. 30, 2002 (DE) ..... 102 56 029

(51) Int. Cl.
*A47L 9/02* (2006.01)
*A47L 5/28* (2006.01)

(52) U.S. Cl. ..... 15/328; 15/363; 15/388; 15/392

(58) Field of Classification Search ..... 15/363, 15/388, 371, 392, 368, 328; *A47L 9/02, A47L 5/28*

See application file for complete search history.

(56) References Cited

U.S. PATENT DOCUMENTS 3,790,987 A * 2/1974 MacFarland ..... 15/392
4,610,047 A * 9/1986 Dick et al. ..... 15/319
6,550,099 B2 * 4/2003 Worwag ..... 15/387

* cited by examiner

*Primary Examiner*—David Redding
(74) *Attorney, Agent, or Firm*—Gudrun E. Huckett

(57) ABSTRACT

A cleaning tool for a vacuum cleaning device has a housing and a motor arranged in the housing. A tool carrier and a rotatingly driven working tool are provided. The working tool has two ends rotatably supported in the tool carrier. The tool carrier and the working tool form a changing unit. The tool carrier is detachably secured on the housing by catch elements. A gear system is connected between the motor and the working tool, wherein the motor drives via the gear system the working tool. The gear system has a driving wheel driven by the motor and a driven wheel fixedly connected to the working tool. The tool carrier and the housing have wall sections that overlap one another and align the tool carrier relative to the housing and the driven wheel relative to the driving wheel when the changing unit is inserted into the housing.

23 Claims, 9 Drawing Sheets

VACUUM CLEANING TOOL HAVING AN EXCHANGEABLE ATTACHMENT

BACKGROUND OF INVENTION

1. Field of the Invention

The invention relates to a vacuum cleaning tool comprising a rotatably driven working tool, in particular, for a vacuum cleaning device such as a vacuum cleaner or the like. The cleaning tool comprises a housing having a bottom plate with a working slot provided on one side of the bottom plate. The working tool rotatably supported within the housing passes through the working slot and acts on the surface to be worked. The cleaning tool also comprises a drive motor arranged in the housing which drives the working tool by means of a gear system. The gear system comprises a driving wheel as well as a driven wheel connected to the working tool.

2. Description of the Related Art

Cleaning tools with a rotatably driven brush roller that are configured as a vacuum cleaning tool are known as attachments for vacuum cleaners. The vacuum cleaning tool is comprised of a housing having a bottom plate in which a working slot extending transversely to the working direction is provided. The brush roller that is rotatably supported within the housing acts through the working slot onto the surface to the worked, for example, a floor surface, an upholstery surface, a carpet or the like. The drive motor for the brush roller is an electric motor, a vacuum air turbine or a similar motor.

In order to achieve excellent cleaning results, the vacuum cleaning tool must be matched to the surface to be cleaned. Smooth floors require a different treatment than carpet, upholstery surfaces or the like. The accessory market therefore offers various vacuum nozzle attachments for particular applications.

SUMMARY OF INVENTION

It is an object of the present invention to configure a cleaning tool with a rotatably driven working tool such that with simple means an adaptation of the working tool to the surface to be cleaned is possible.

In accordance with the present invention, this is achieved in that the working tool is rotatably supported with both ends in a tool carrier and forms, together with the tool carrier, a changing unit, in that the tool carrier and the housing have overlapping wall sections that align the tool carrier relative to the housing and the driven wheel relative to the driving wheel, and in that the tool carrier is detachably secured with snap-on or catching fastening means on the housing of the cleaning tool.

The working tool itself is secured with both its ends captively on a tool carrier and forms together with it a changing unit. The tool carrier is connected via a receiving slot or the like to the housing of the cleaning tool, preferably, it is inserted into the housing and secured at the housing in an exchangeable fashion, preferably by a snap-on or catch connection. Accordingly, the operator, by changing the cleaning tool, can carry out an adaptation to the floor surface to be cleaned for which purpose a simple exchange of the changing unit is required. The detachment of the changing unit from the housing also provides the possibility for a simple cleaning of the working tool itself because the operator has essentially free access to it within the changing unit. The tool carrier of the changing unit and the housing of the vacuum cleaning tool have overlapping wall sections which align the tool carrier relative to the housing and the driven wheel relative to the driving wheel so that the tool carrier can be mounted in the correct position within the housing without requiring particular skills of the user; moreover, the tool carrier is detachably secured by means of snap-on fastening means or catch means. The drive connection to the drive motor is realized without requiring tools and is easily released when removing the tool carrier. The working tool can be in the form of brush rollers, polishing rollers, beater bars, refresher rollers or the like; they form together with the tool carrier an independent changing unit, respectively. It can be advantageous to configure, as an alternative, one of the changing units as a static vacuum nozzle, wherein the drive unit is switched off in this case.

Preferably, the tool carrier is inserted via a receptacle like a drawer into the housing of the cleaning tool, wherein the overlapped wall sections ensure guiding of the tool carrier within the housing.

The working slot through which the working tool acts onto the surface to be cleaned is expediently configured within the tool carrier itself such that the glide surface of the working tool facing the floor can be exclusively provided on the tool carrier. For this purpose, the tool carrier is advantageously designed as a closed frame which forms the glide surface of the cleaning tool.

The tool carrier is advantageously secured in the housing of the cleaning tool by means of a snap-on or catch connection that can be easily released and ensures a safe and captive securing action of the changing unit in the housing. Expediently, at least at one end of the tool carrier a first catch element is provided that cooperates with a second catch element fastened on the housing. In order to enable a simple pushing action for removing the tool carrier from the housing, a projection is provided on the tool carrier which engages an opening on the topside of the housing so that the tool carrier can be pushed out of the receiving slot like a drawer by activation from the topside of the housing.

As an advantageous gear connection between the drive motor and the rotatably driven working tool, any easily detachable gear system is expedient, in particular one that is detachable without tools, for example, a friction wheel system, a gear wheel system, or the like. In a special embodiment of the invention, the gear connection is a frictional grooved gearing with an intermediate wheel whose peripheral area is in active engagement, similar to a V-belt, with the driven wheel of the working tool, wherein the active engagement can be detached or released without a tool. The intermediate wheel, configured as a V-gear, is preferably elastically embodied at its outer periphery and engages in a force-transmitting way with this elastic outer periphery the groove of the driven wheel and preferably that of the driving wheel.

According to a further embodiment of the invention, the vacuum flow (suction air flow) that enters through the working slot is guided via a vacuum channel to a connecting socket for a vacuum pipe, wherein the vacuum channel is positioned between the bottom plate of the housing and the drive shaft of the drive motor. Expediently, the vacuum channel is delimited by the drive motor itself. When the drive motor is configured as an electric motor, the vacuum flow can be used simultaneously as a cooling flow.

In order to ensure an advantageous flow between the working slot and the connecting socket, the exit cross-section of the vacuum channel is greater than its intake cross-section, preferably also greater than the flow cross-section of the connecting socket. The flow transition section between the vacuum channel and the connecting socket is expediently in the form of a collector that, in particular, is arranged to be pivotable about a pivot axis that is parallel to the drive shaft within the housing. The collector is provided with a guide ramp adjoining downstream the bottom surface of the vacuum channel and bridging a vertical displacement between the vacuum channel and the connecting socket.

DETAILED DESCRIPTION

Figure 1:
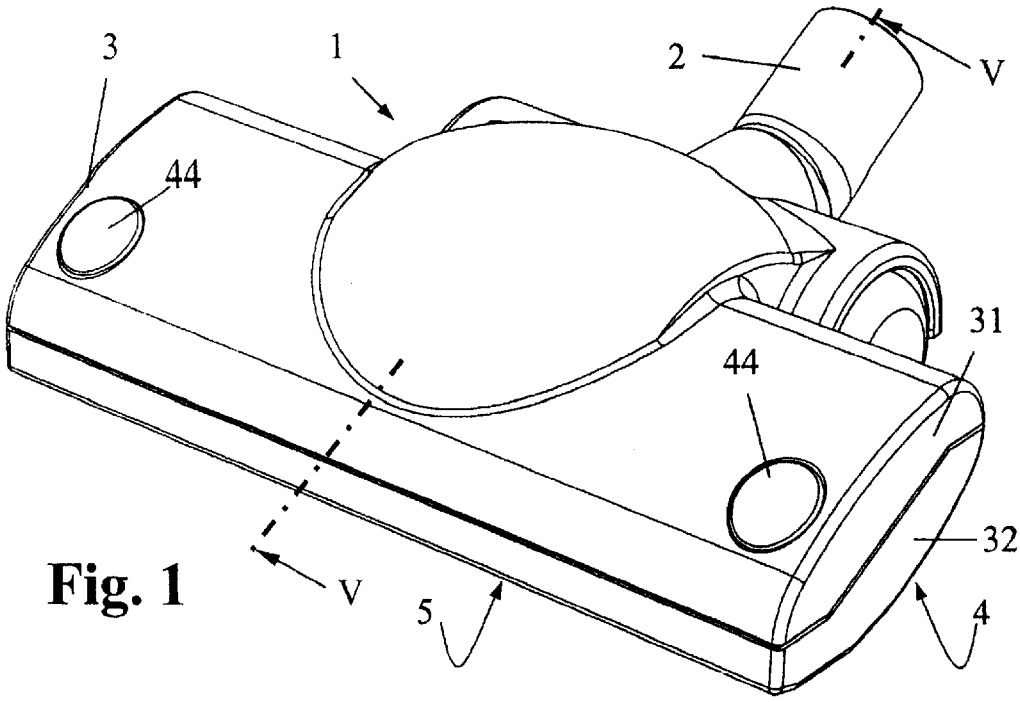
FIG. 1 is a perspective view of a cleaning tool according to the invention.
Figure 2:
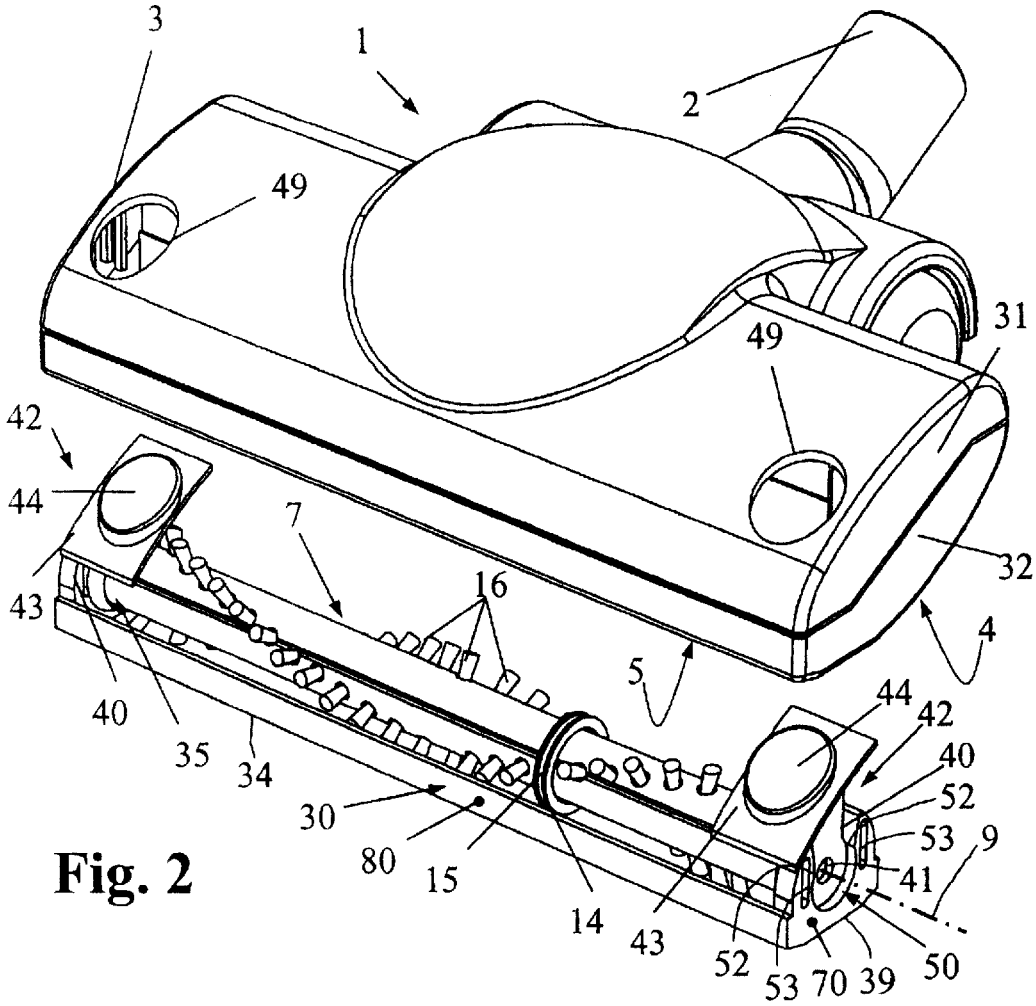
FIG. 2 is a perspective view of the cleaning tool according to FIG. 1 with the tool carrier in the pushed-out position.
Figure 7:
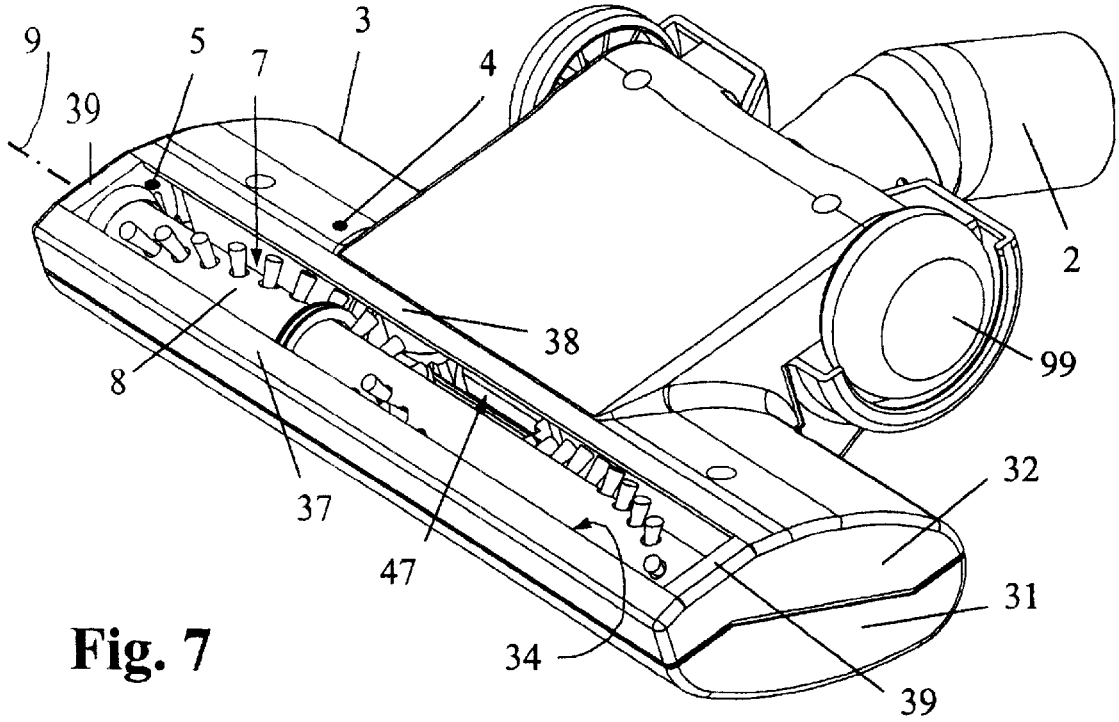
FIG. 7 is a view of the cleaning tool according to FIG. 6 with the tool carrier inserted and locked in place.
Figure 8:
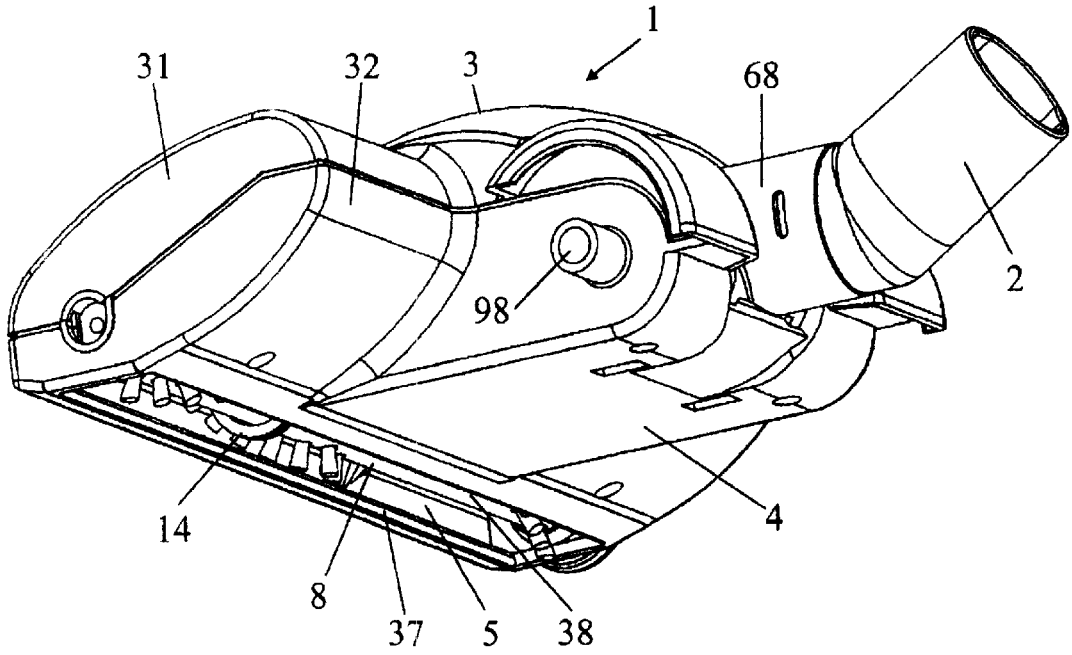
FIG. 8 is a perspective illustration of the cleaning tool with detached running wheels.

The cleaning tool 1 illustrated in FIGS. 1 and 2 in a perspective view from the front is provided for connection to a vacuum cleaning device (not illustrated) such as a vacuum cleaner or the like. By means of a connecting socket 2, the cleaning tool 1 is connected to the vacuum hose of a vacuum cleaning device. In the illustrated embodiment, the housing 3 of the cleaning tool is comprised of a top part 31 and a bottom part 32. The bottom part 32 has a bottom plate 4 illustrated in FIGS. 6 through 8. On the side of the housing where the bottom plate 4 is located a working slot 5 (FIG. 7) is provided via which the working tool 7 acts on the surface to be worked. In the illustrated embodiment, the working tool 7 is a brush roller 8 that is secured in the housing 3 so as to be rotatable about a horizontal axis 9. It is provided on its periphery with bristles 16.

Figure 3:
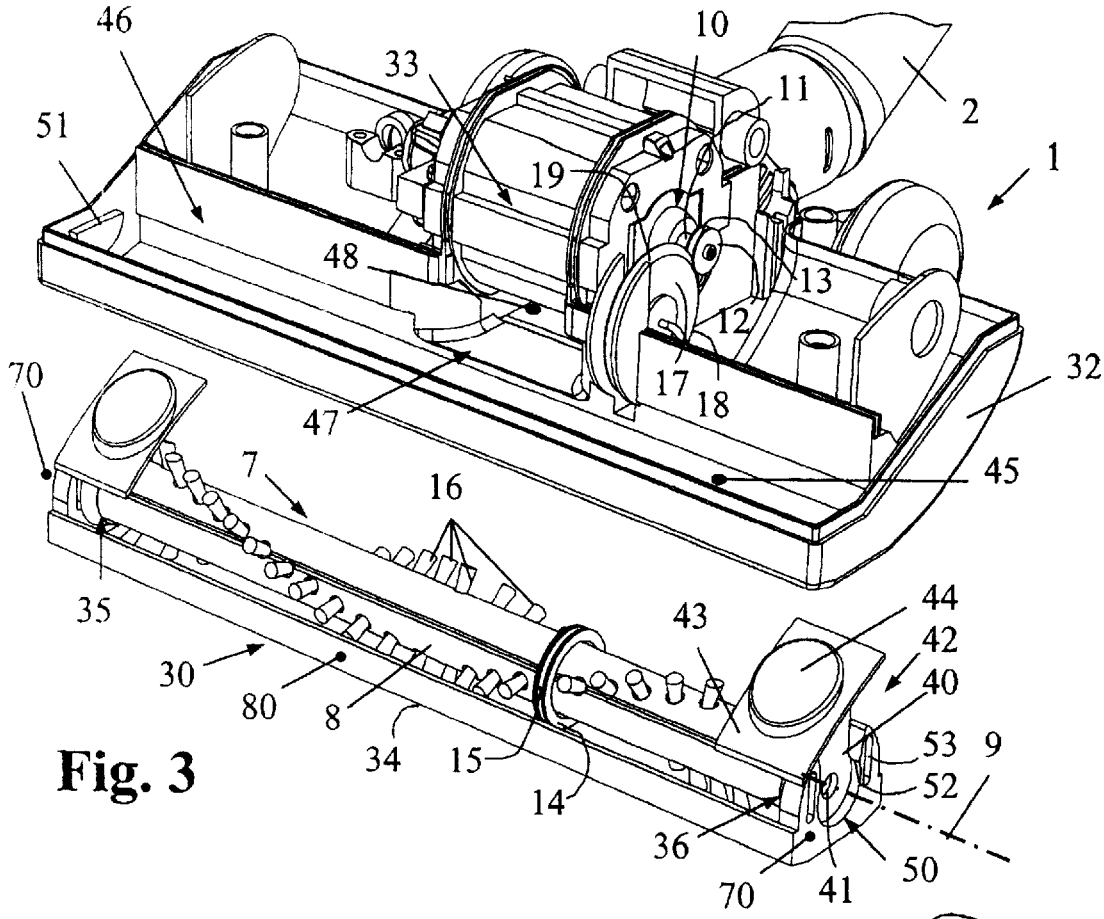
FIG. 3 is a view onto the cleaning tool according to FIG. 2 showing the housing opened.
Figure 4:
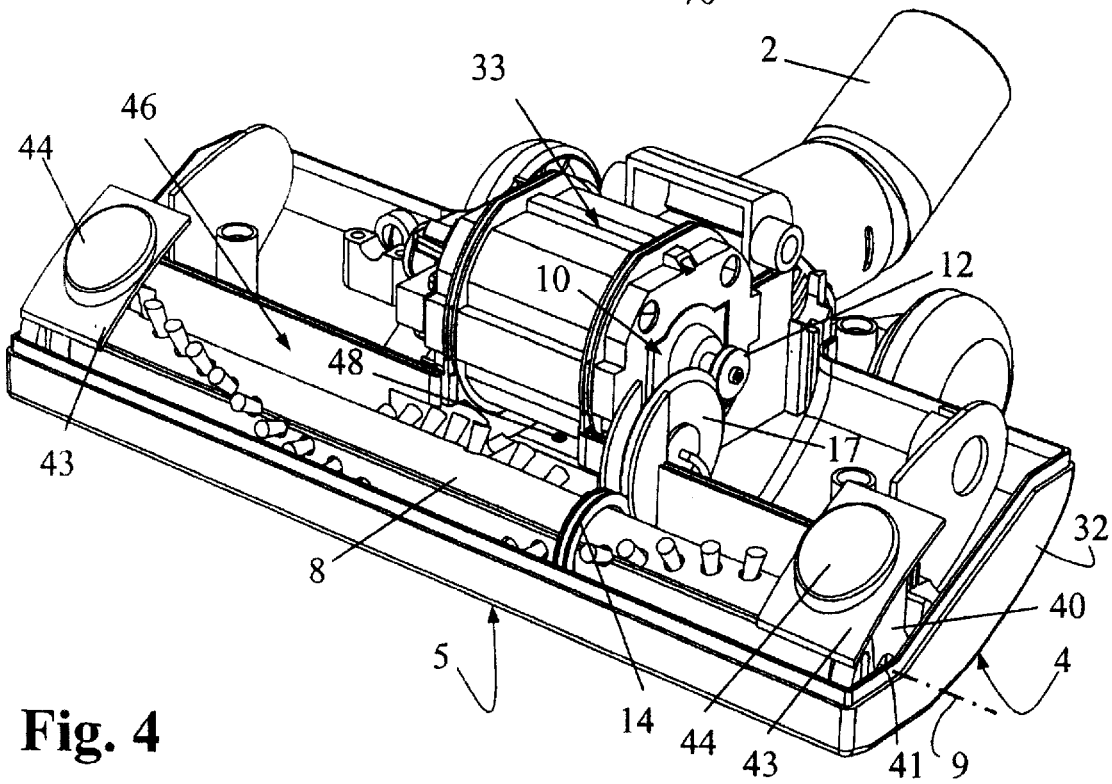
FIG. 4 is a view onto the cleaning tool according to FIG. 1 with the housing opened.

As illustrated in FIGS. 3 and 4, the working tool 7, i.e., the brush roller 8, is driven by a motor 33 that, in the illustrated embodiment, is an electric motor. It can be expedient to employ instead of the electric motor a vacuum turbine or a like motor as a drive for driving the working tool 7.

On the shaft 11 of the drive motor 33 (FIGS. 3, 4) a driving wheel 12 is attached which interacts by means of an intermediate wheel 17 with the driven wheel 14 that is fixedly connected to the working tool 7. Like a V-gear, the intermediate wheel 17 is in active engagement in the area of its periphery 18 with the driving wheel 12 on one side and with the driven wheel 14 on the other side, wherein this driving connection can be engaged and disengaged without great expenditure without requiring a tool.

In the illustrated embodiment, the driving wheel 12 and the driven wheel 14 are configured as V-belt pulleys having an outer peripheral groove 13, 15. The intermediate wheel 17 is shaped as a V-gear having at its outer periphery 18 a driving ring configured as a V-belt ring 19 that engages the peripheral grooves 13 and 15 of the driving wheel 12 and the driven wheel 14 like a V-belt in a torque-transmitting way. For this purpose, the V-ring 19 is preferably made of elastic material, for example, a polyurethane mixture, and has a substantially trapezoidal cross-section as it is known in connection with a V-belt. Other configurations of the driving ring can be advantageous. For transmitting a high output, it can be expedient to embed in the material of the V-ring 19 a fabric that can take up forces as an inner tension cord.

In the illustrated embodiment, the gear system 10 comprised of the wheels/gears 12, 14, and 17 is configured as a frictional grooved gear system, i.e., the torque is transmitted by friction via the flanks of the peripheral grooves 13 and 15 as well as the V-ring 19. In this connection, when the driving wheel 12 is driven, the drive forces act such that a positive-locking gear connection (at 10) is provided. It is advantageous in this connection that as a result of the friction pairing only a certain maximum torque can be transmitted; when the working tool 7 locks, the gear system 10 can slip so that in this way an overload protection is provided.

It can be expedient to employ instead of the illustrated gear system 10 a friction gear system, a toothed gearing, or the like, that can be engaged and disengaged without requiring tools. The working tool 7 rotatingly supported in the housing 3, as shown in FIGS. 2 and 3, is secured at its ends 35, 36 in a tool carrier 30 and forms together with it a changing unit insertable into the housing 3. The tool carrier 30 is comprised preferably of a closed frame 34, as illustrated in particular in the illustration of FIG. 7. This closed frame 34 has two longitudinal stays 37 and 38 that extend approximately parallel to the axis of rotation 9 of the working tool 7 and are fixedly connected to one another at their ends by short transverse stays 39. The transverse stays 39 form the lower edge of the axial end faces 40 of the tool carrier 30. Slide bearings 41 (FIG. 3) are mounted in the end faces 40 and rotatably secure the working tool 7. The working tool 7 is secured between the two end faces 40 in a captive way within the frame-shaped tool carrier 30. The axis of rotation 9 of the working tool 7 is positioned above the frame 34 which is formed as a monolithic part comprised of the longitudinal stays 37 and 38 and the transverse stays 39.

In the area of the wall section 70 of the end faces 40 of the tool carrier 30, projections 42 are provided that are positioned approximately at a right angle relative to the plane defined by the frame 34. These projections 42 have at their free ends a stop surface 43 where an approximately cylindrical raised portion is positioned that acts as an actuating button 44. As illustrated in the Figures, the ends 39 of the tool carrier 30 are identical but mirror-symmetrical to one another in the illustrated embodiment.

Figure 5:
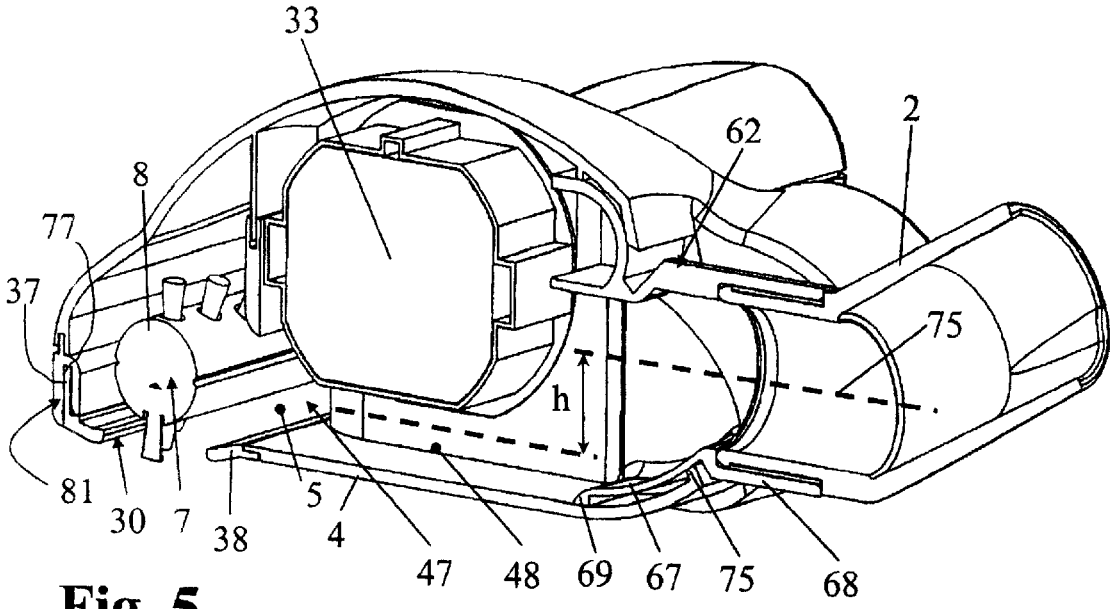
FIG. 5 section of the cleaning tool according to the invention along the line V-V in FIG. 1.
Figure 6:
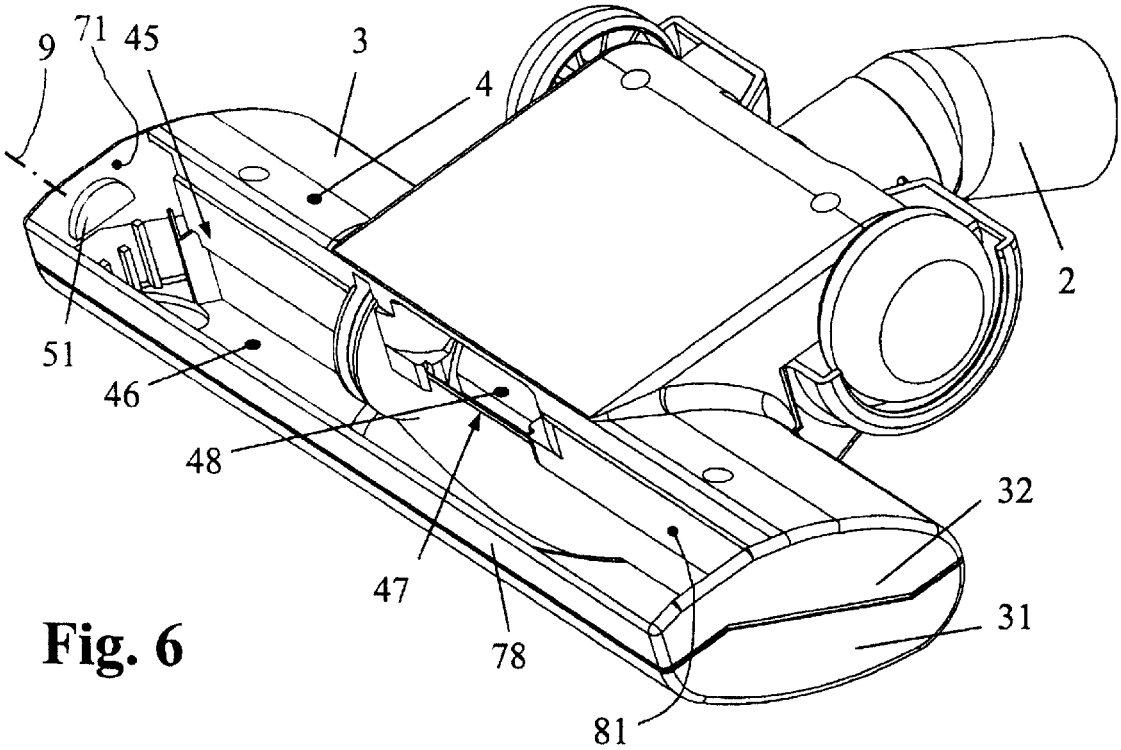
FIG. 6 is a bottom view of the cleaning tool with the tool carrier removed.

In the bottom plate 4 of the bottom part 32 of the housing 3, a receiving slot 45 (FIG. 6) is provided that extends across the entire width of the cleaning tool 1. This receiving slot 45 ensures free access to a vacuum chamber 46 in which the changing unit with the working tool 7 or the brush roller 8 is positioned. As illustrated in FIGS. 5 and 6, the vacuum nozzle 47 of a vacuum channel 48 opens approximately centrally into the vacuum chamber 46; the vacuum channel 48 extends underneath the drive motor 33 from the vacuum chamber 46 to the connecting socket 2. From the exterior, the vacuum flow (suction air flow) enters via the working slot 5 into the vacuum chamber 46 and flows via the vacuum nozzle 47 and the vacuum channel 48 below the drive motor 33 to the connecting socket 2 and from there to the vacuum cleaning device. The vacuum channel 48 is positioned between the bottom plate 4 and the drive shaft 11 of the drive motor 33. Preferably, the vacuum channel 48 is delimited by the drive motor 33 itself. The vacuum channel 48 widens at its end facing the connecting socket 2, wherein the exit cross-section of the vacuum channel 48 is greater than its intake cross-section in the area of the vacuum nozzle 47. Preferably, the exit cross-section of the vacuum channel 48 is also greater than the flow cross-section of the connecting socket 2.

The closed frame 34 of the tool carrier 30 is surrounded in its mounted position by the receiving slot 45 essentially without play. In this connection, a leg of the approximately L-shaped transverse stay 37 engages a receiving groove 77 that is provided across the length of the receiving slot 45 in the forward housing wall 78 of the bottom part 32.

As illustrated in FIG. 5, one of the legs of the transverse stay 37 that is L-shaped in cross-section is engaged by the leading housing wall 78 so that a reinforcement of the tool carrier 30, on the one hand, as well as of the leading housing wall 78 of the housing 3, on the other hand, is achieved. In addition, by means of the positive-locking engagement of the transverse stay 37 in the receiving groove 77 of the housing 3, the tool carrier 30 is forced into the mounting position so that the tool carrier 30 can be mounted in a precisely aligned position within the housing. Because of the wall sections 70, 80 on the tool carrier 30 and the corresponding inner wall sections 71, 81 of the housing 3, a position-correct alignment of the driven wheel 14 on the rotatingly driven working tool 7 relative to the driving wheel 12 of the motor 33 is ensured. When inserting the tool carrier 30, the tool carrier is aligned by means of the wall sections 71 and 81 of the housing 3 so that with the insertion action at the same time a position-correct connection of the gear system 10 is ensured.

In the shown embodiment, the tool carrier 30, with the projections 42 leading, is inserted like a drawer into the receiving slot 45 of the bottom plate 4, wherein the actuating buttons 44 come to rest in matching openings 49 of the top part 31 of the housing. The stop surfaces 43 form wall sections of the tool carrier 30 that rest against the inner wall of the housing part 31 and in this way seal the opening 49 safely against air leak.

The outer sides of the end faces 40 are provided with locking receptacles 50 that interact with locking cams 51 provided on the sidewalls 71 of the housing 3, in particular, on the bottom part 32. The locking cams 51 have approximately a semi-circular configuration wherein the circle section is positioned so as to face the opening of the receiving slot 45. The locking receptacles 50 have a configuration matching that of the locking cams 51 and are provided with locking noses 52 that point toward the locking receptacles 50 and are positioned diametrically opposite one another approximately at the level of the diameter of the semi-circular locking receptacles 50.

In order to provide a satisfactory spring action of the locking noses 52, hollow spaces 53 are provided behind the locking noses 52 in the end wall 40. The wall thickness that is provided in this way has elastic properties because the tool carrier 30 is preferably made of plastic material.

The tool carrier 30 is inserted like a drawer into the receiving slot 45 wherein the locking cams 51 enter the locking receptacles 50 and, at the same time, the actuating buttons 44 engage the openings 49 of the upper housing part 31. In this connection, the wall sections 70 and 80 of the tool carrier 30 in cooperation with the wall sections 71 and 81 of the housing 3 provide a guiding action. The tool carrier 30 is inserted so deep into the housing 3 that the locking noses 52 engage behind the locking cams 51 approximately at the level of the diameter and the tool carrier 30 is captively secured in the housing 3. Since the gear system 10 can be disengaged easily without tools and, as a result of the position-correct alignment of the driving wheel 12 and the driven wheel 14, can be engaged again without tools, the insertion of the tool carrier 30 into the receiving slot 45 simultaneously realizes the drive connection of the gear system 10. In this connection, in the case of a configuration as a frictional grooved gear system, the circumference of the intermediate wheel 17 (V-gear) engages the circumferential groove 15 of the driven wheel 14 so that a connection enabling a high torque transmission similar to a V-belt connection is realized.

Figure 16:
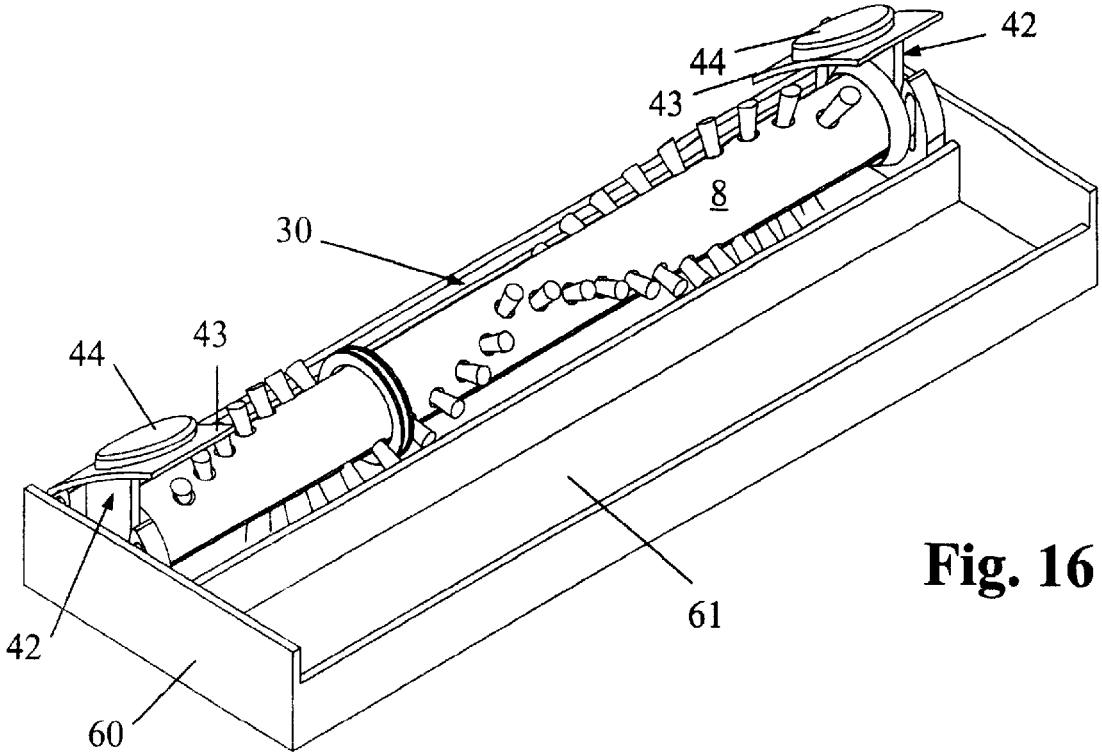
FIG. 16 is a perspective view of a box for storing changing units with different working tools.

When exchanging the working tool 7, the actuating buttons 44 are pressed down from the top part 31 in order to push the tool carrier 30 against the force of the locking action of the catch connection out of the receiving slot 45. Since the projections 42 are formed as extensions of the lateral walls 40 of the tool carrier 30 and the locking action is located within the sidewall 40, the force introduction is realized directly in the area of the locking action so that easy detachment or release of the locking connection is ensured. The user can exchange with a few manipulation steps without needing a tool the first tool carrier 30 with the illustrated brush roller 8 for another tool carrier with a working tool that is also configured as a changing unit. As illustrated in the instant embodiment, the tool carrier 30 together with its working tool 7—of any configuration—forms the changing unit. In this connection, it is expedient to provide a receiving box 60 for intermediate storing of exchangeable changing units; the box 60 has several receiving compartments 61 for several changing units as illustrated in FIG. 16. The illustrated receiving box 60 has two compartments 61 for two changing units.

Figure 12:
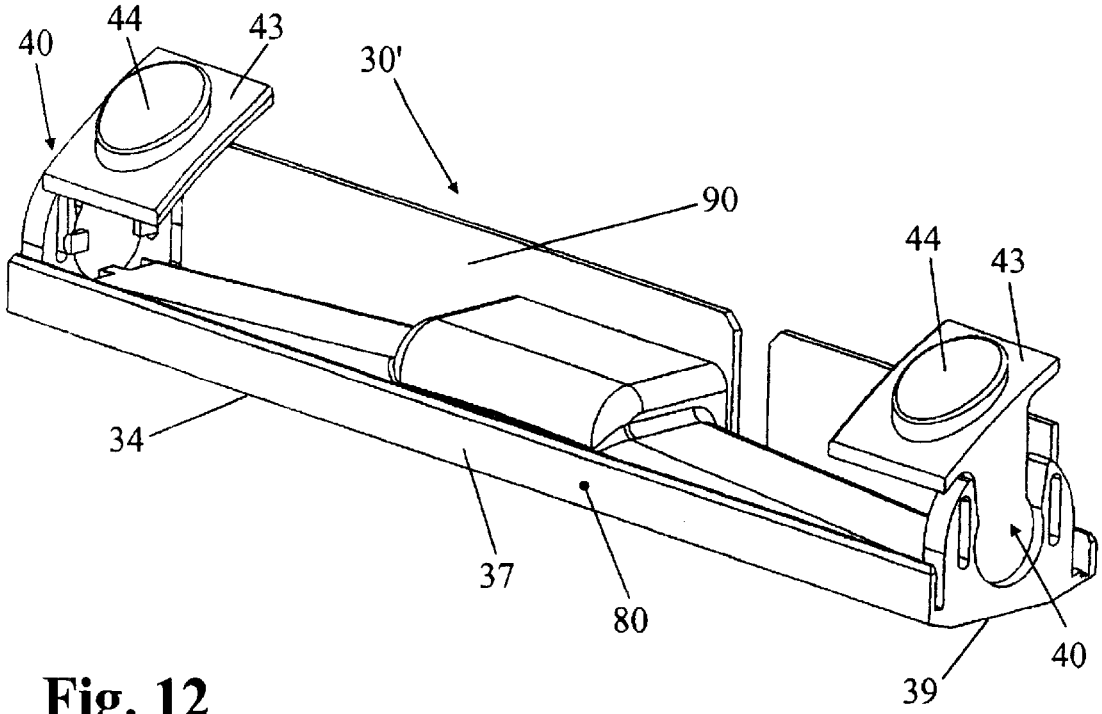
FIG. 12 is a perspective illustration of a changing unit in a view from the front.
Figure 13:
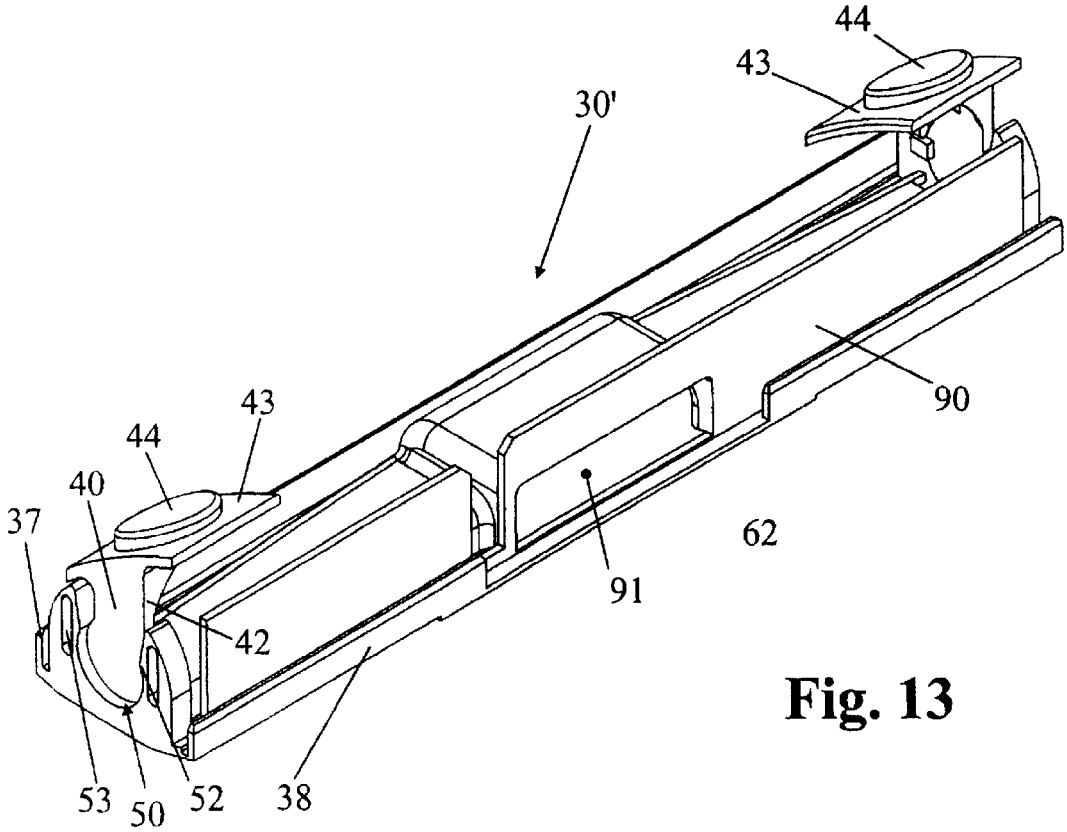
FIG. 13 shows a perspective illustration of the changing unit according to FIG. 12 in a view from the rear.
Figure 14:
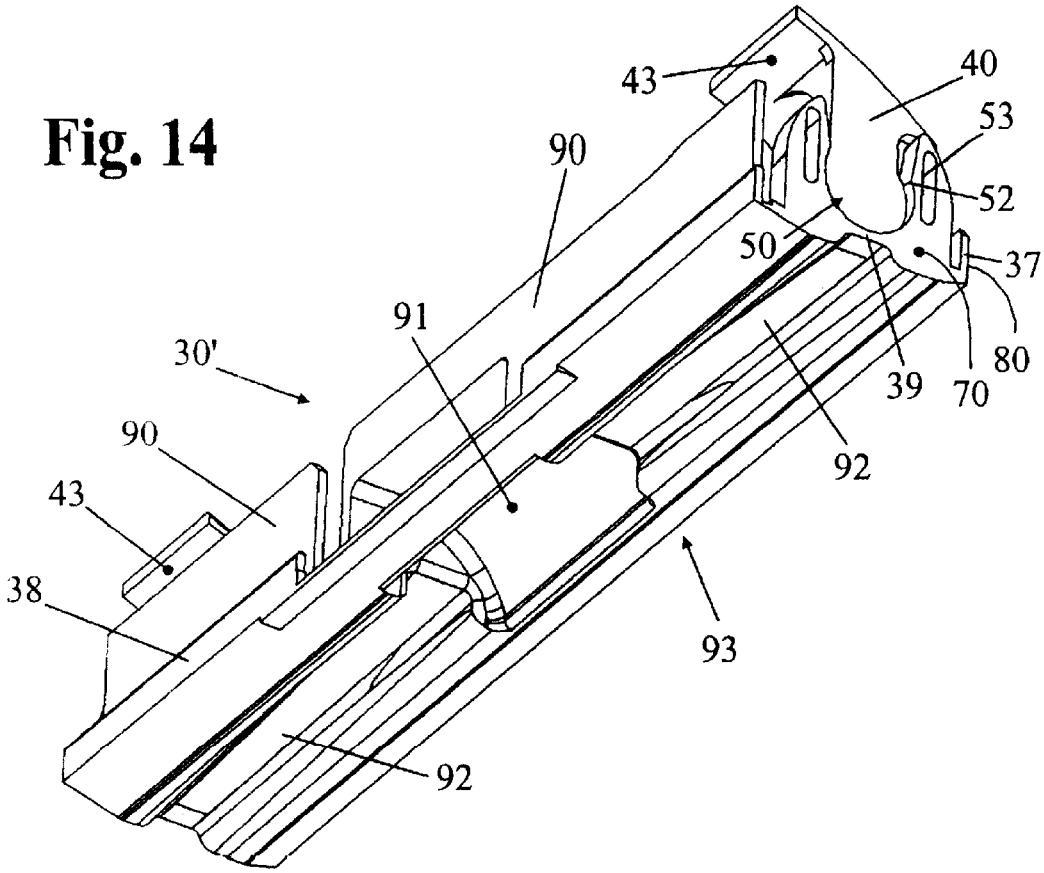
FIG. 14 is a perspective illustration of a changing unit in an embodiment configuration as a vacuum shoe.

As illustrated in detail in FIGS. 12 to 15, the changing unit 30' can be embodied without a rotating working tool. The changing unit 30' comprises a frame-shaped tool carrier 30 whose frame 34 is combined of longitudinal stays 37, 38 as well as transverse stays 39 connecting them. In the area of the transverse stays 38 facing the vacuum nozzle 47, sealing partitions (barrier walls) 90 are provided that essentially seal the vacuum chamber in the housing 3 relative to the vacuum channel 48. As illustrated in FIG. 14, in the changing unit 30' a central vacuum chamber 91 is formed adjoined by vacuum grooves 92 extending within the glide plate 93. The vacuum grooves 92 extend approximately parallel to the longitudinal stays 37 and 38 from the central vacuum chamber 91 to the end faces 40 of the tool carrier 30. With the changing unit 30' illustrated in FIGS. 12 to 14, the cleaning device can be converted easily into a simple vacuum tool without a driven working tool.

Figure 15:
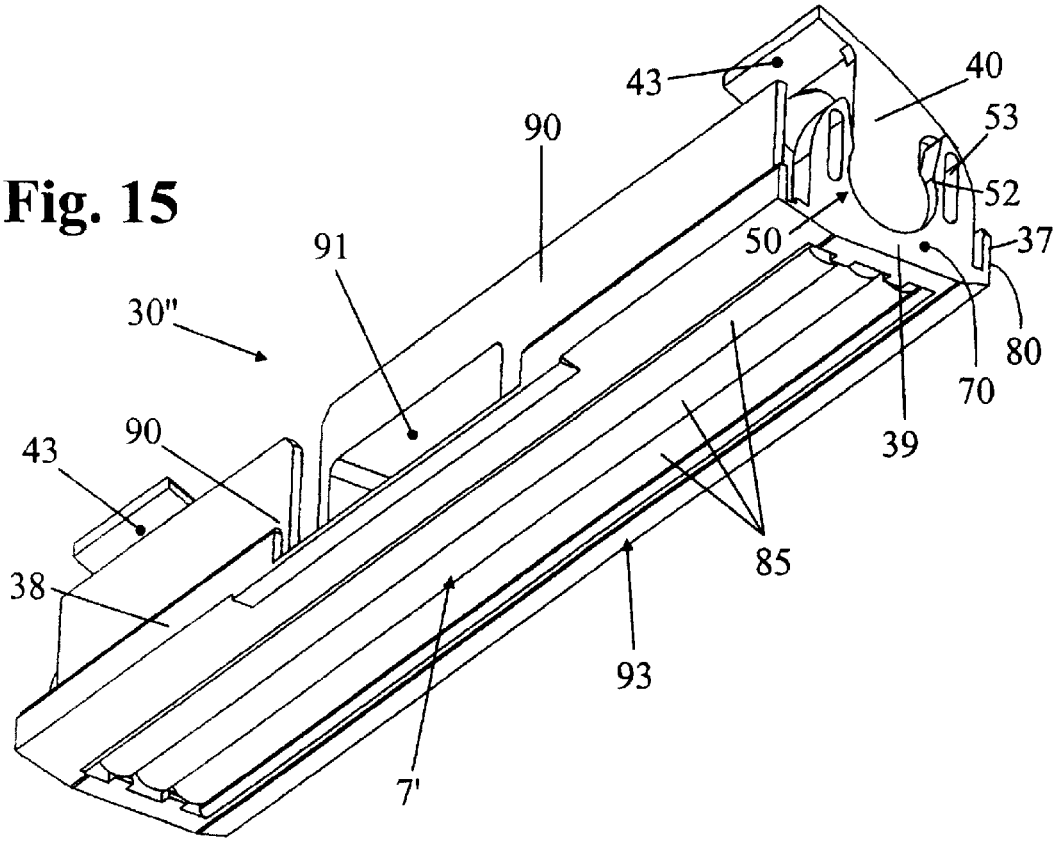
FIG. 15 is a perspective view of the changing unit according to FIG. 14 in a perspective view from below with beater bars as a working tool.

The changing unit 30" according to FIG. 15 corresponds with regard to its configuration to the changing unit 30' according to FIGS. 12 to 14. In the glide plate 93, however, working tools 7' are mounted that are comprised of flexible rubber beads 85. In the illustrated embodiment, three such rubber beads 85 are positioned closely adjacent to one another and extend across the entire length of the changing unit 30". When across the central vacuum chamber 91 a suction air flow is generated, the suction air is taken in between the rubber beads 85 into the flow channels wherein the rubber beads 85 are elastically deflected and swing back into their initial positions as a result of their elasticity. In this way, beating movements result so that the changing unit 30" can serve as a beater tool for working carpet, a rug or the like. This changing unit 30" also becomes operative simply by insertion into the housing of the cleaning tool without rotating working tools being required.

In the illustrated embodiment, the tool carrier 30 with the brush roller 8 is provided for vacuum operation. It can be expedient to provide on the tool carrier 30 according to FIGS. 2 and 3 a sealing partition or barrier wall 90 as illustrated in the changing units 30' and 30". By means of such a barrier wall, the vacuum nozzle 47 can be sealed relative to the vacuum chamber 46 so that no suction air can flow through the working slot 5 of the tool carrier 30. In this position, the cleaning tool can be used for working in cleaning agents, such as shavings, cleaning power or the like, by means of the brush roller.

The housing 3 of the cleaning tool can be comprised of plastic material that must not fulfill any particular requirements. The glide plate resting on the surface to be cleaned can be made of a higher quality plastic material, of metal, of diecast material, or a suitable alloy and is formed exclusively of the frame 34 of the tool carrier 30, i.e., the longitudinal stays 37 and 38 as well as the transverse stays 39. The configuration according to the invention is therefore advantageous also with regard to the employed material. Only the area of the tool carrier 30 or of its frame 34 must be manufactured of a higher quality material, for example, plastic, metal, diecast material or the like.

Figure 9:
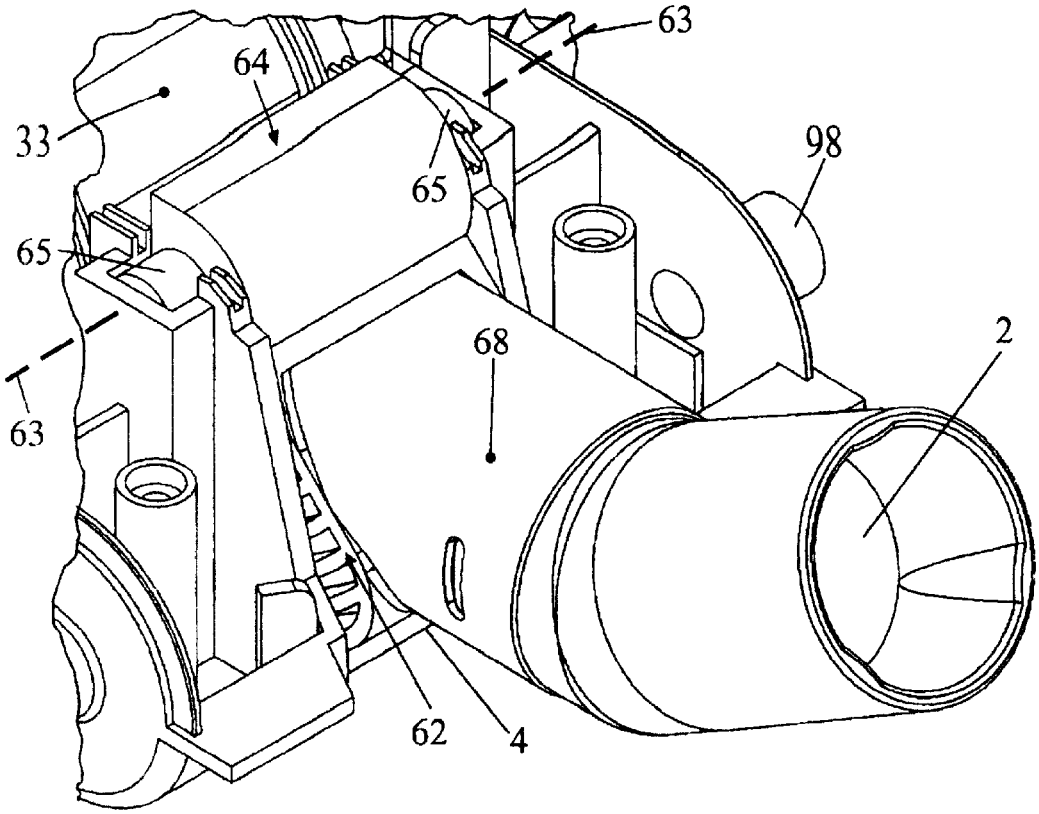
FIG. 9 shows in an enlarged illustration the connecting socket of the cleaning tool.
Figure 10:
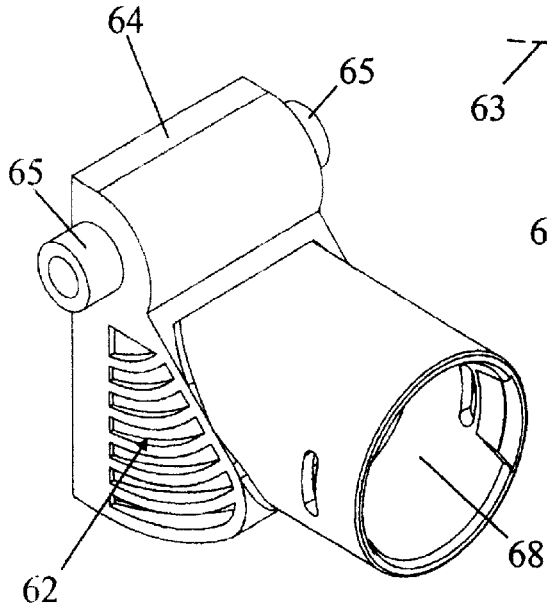
FIG. 10 is a perspective side view of the collector arranged between the vacuum channel and the connecting socket.
Figure 11:
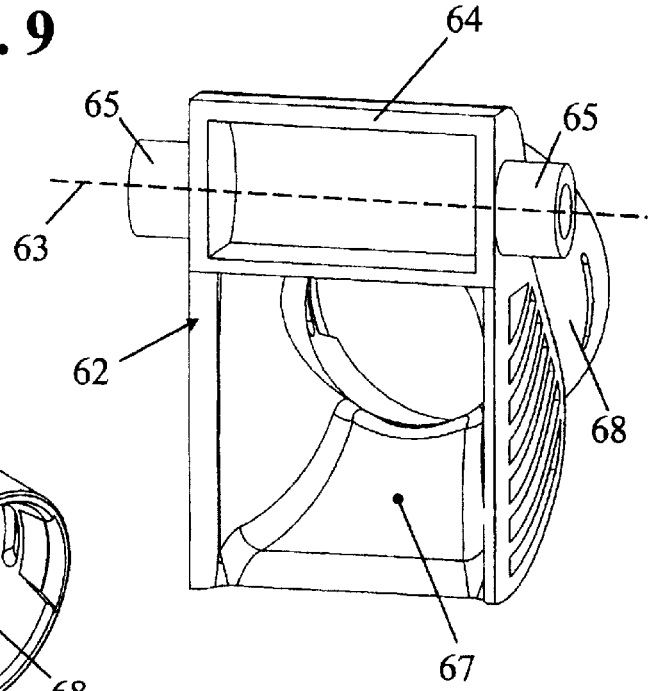
FIG. 11 shows a view onto the collector according to FIG. 10 in a view from the front.

In the illustrated embodiment (FIG. 5), the vacuum channel 48 is guided underneath the drive motor and widens toward the end facing the connecting socket 2. In order to ensure a flow-technologically advantageous removal of the vacuum flow via the connecting socket 2, a collector 62 is provided according to the invention between the widened exit cross-section of the vacuum channel 48 and the connecting socket 2. The collector transforms the exit cross section of the vacuum channel 48 into the outflow cross-section of the connecting socket 2. As illustrated in the section view of FIG. 5 and the illustrations of FIGS. 9 through 11, the collector 62 is secured within the housing 3 so as to be pivotable about a pivot axis 63 that is parallel to the drive shaft 11 of the motor 33. The pivot axis 63 is provided at the end 64 of the collector 62 facing away from the bottom plate 4 and is formed by journals 65 engaging corresponding bearing receptacles 66 of the housing 3. As illustrated in FIGS. 5 and 11, the collector has at its end opposite the pivot axis 63 a guide ramp 67 that rises in an arc shape or circular section shape to a higher positioned pipe section 68 that is provided for connection to the connecting socket 2. The connecting socket 2 is secured so as to be rotatable about an axis 75 within the pipe section 68. As illustrated in FIG. 11, the collector has a rectangular cross-section at the intake end. The exit side is formed by the monolithic pipe section 68. The width of the collector matches, measured in the direction of the pivot axis 63, approximately the width of the connecting socket 2 or of the pipe section 68.

As illustrated in FIG. 5, the guide ramp 67 bridges a vertical displacement h between the vacuum channel 48 and the connecting socket 2 that removes the suction air. In this connection, the leading end 69 of the guide ramp 67 glides on the correspondingly curved bottom of the vacuum channel 48 wherein pivoting is limited by a stop 75.

With the described configuration and arrangement as well as shape of the collector 62 a high-performance flow connection between the vacuum channel 48 and the connecting socket 2 is ensured. This ensures, on the one hand, a flow at high flow velocities that can transport without disruptions a heavy dirt load. In particular when using an air turbine as a drive motor for a rotating working tool 7, the good flow connection ensures a high yield of the suction air flow between the vacuum nozzle 47 and the connecting socket 2.

Figure 17:
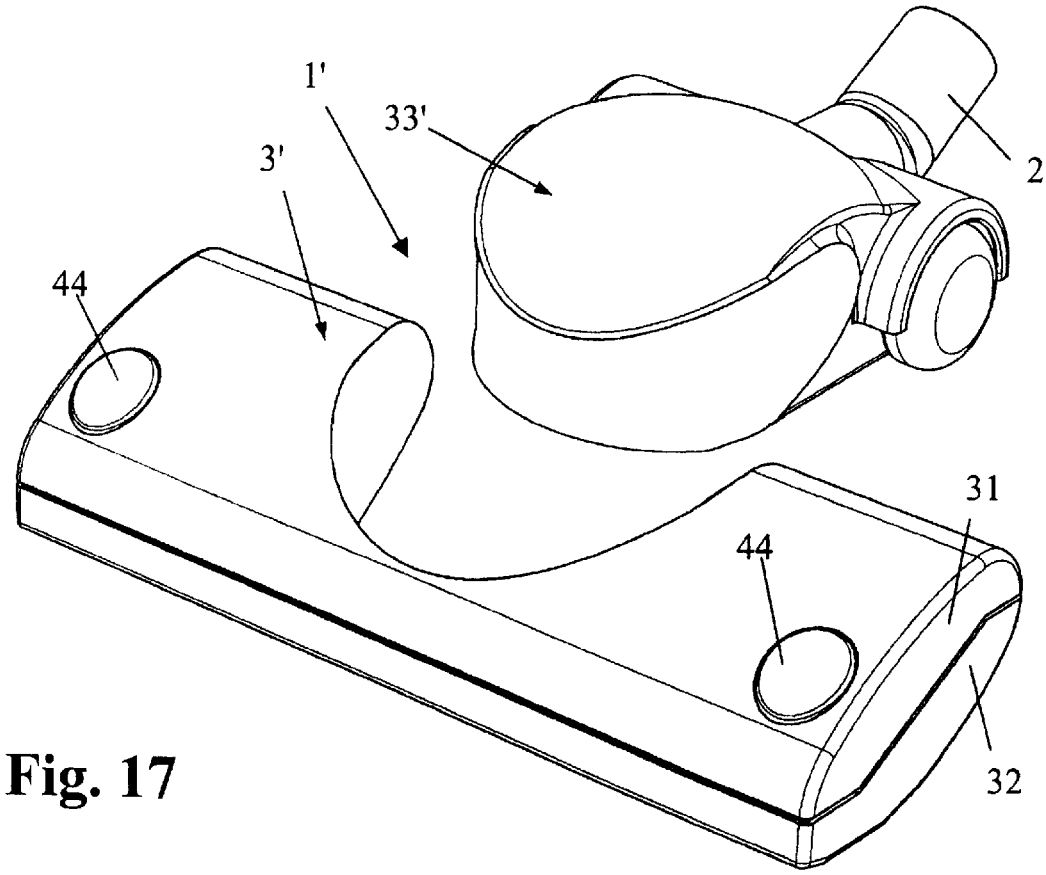
FIG. 17 is a perspective view of a cleaning tool according to the invention with a divided basic housing.

In the embodiment of FIG. 17, the cleaning tool 1' is divided into a housing 33' for a drive unit and a housing 3' with a changing unit for working tools. The division of the cleaning tool 1' itself into the housing 3' with the changing unit and the drive unit 33' enables, for example, the manufacture of standardized components. For example, the drive unit 33' for housings of different width can be identical or a drive unit 33' with an electric motor can be exchanged for a drive unit with an air turbine. The manufacturer only needs to combine the required components in accordance with the desired end product and can employ for this purpose the standardized components so that, despite the fact that many products are available, an inexpensive manufacture is possible.

Figure 18:
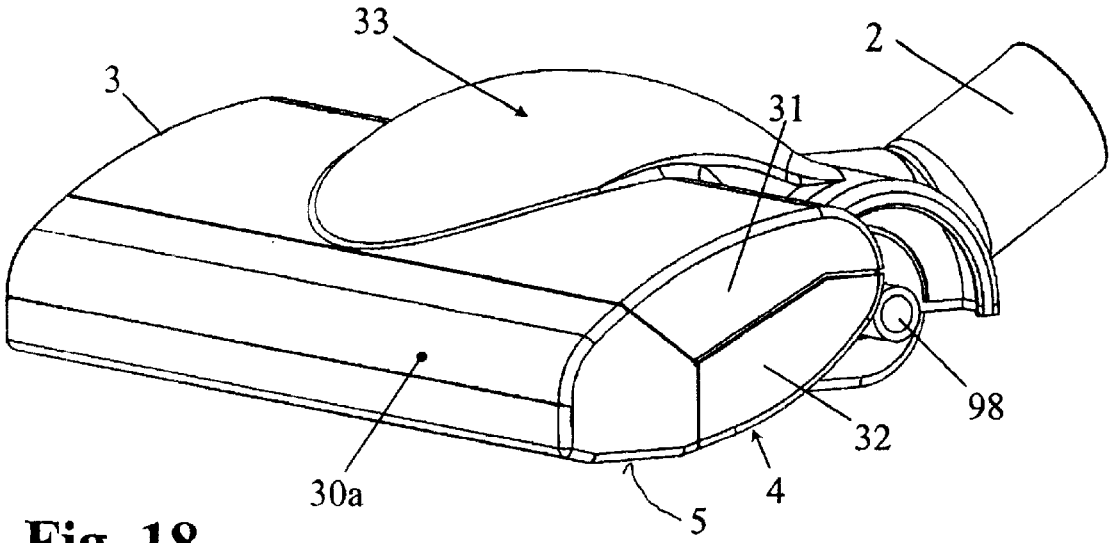
FIG. 18 is a perspective view of a cleaning tool with a changing unit slipped over the forward end of the basic housing.
Figure 19:
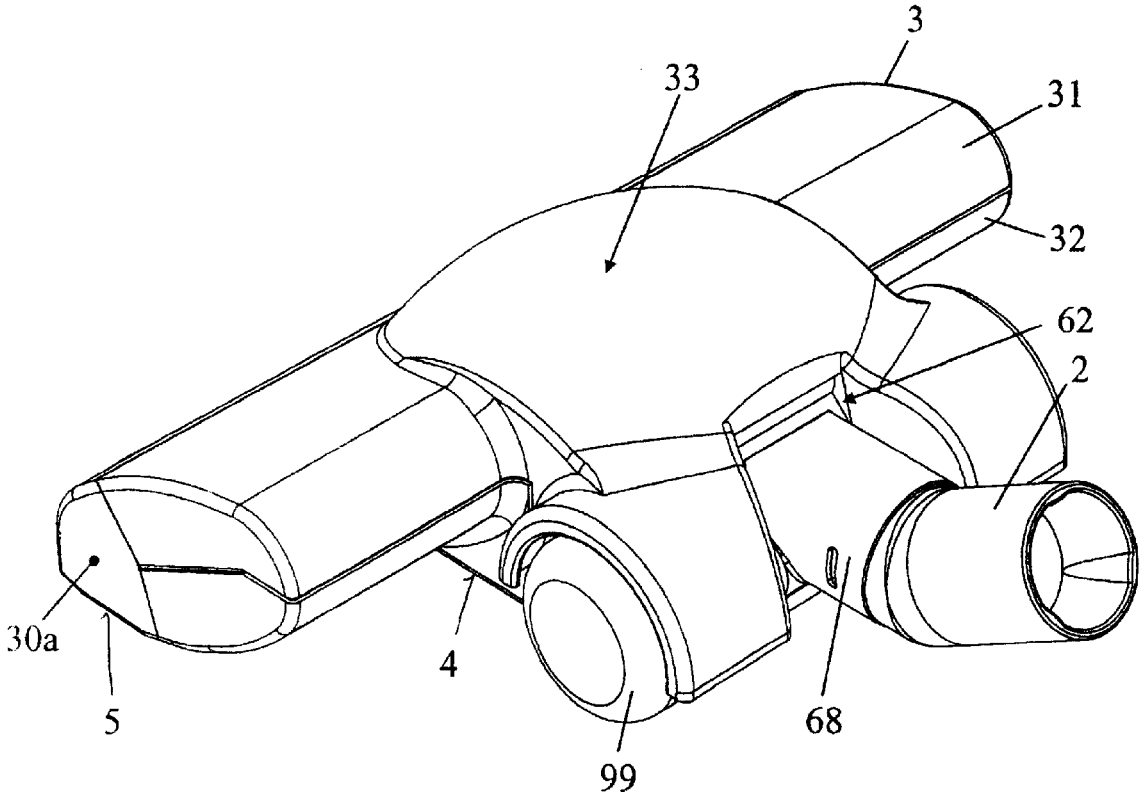
FIG. 19 is a perspective illustration of the cleaning tool according to FIG. 18 in a view from the rear.

FIGS. 18 and 19 show an alternative of a vacuum cleaning tool according to the invention with a changing unit **30*a*. It is configured such that it is placed like a shoe onto the forward end of the housing 3 and can be locked at the housing. The changing unit 30*a*, like the above described changing units, has in the area of the bottom plate 4 a working slot 5** that extends across the width of the vacuum cleaning tool and is a part of the changing unit.

The running wheels 99 to be secured on the vacuum cleaning tool are preferably mounted on axle stubs 98 that are manufactured as a unitary part of the housing 3 of the vacuum cleaning tool.

While specific embodiments of the invention have been shown and described in detail to illustrate the inventive principles, it will be understood that the invention may be embodied otherwise without departing from such principles.

What is claimed is:

1. A cleaning tool for a vacuum cleaning device, the cleaning tool comprising:

a housing;

a motor arranged in the housing;

a tool carrier and a rotatingly driven working tool acting on a surface to be cleaned, wherein the working tool has two ends rotatably supported in the tool carrier;

wherein the tool carrier and the working tool form a changing unit and the tool carrier is detachably secured in a mounted position on the housing by catch elements;

a gear system connected between the motor and the working tool, wherein the motor drives via the gear system the working tool;

wherein the gear system has a driving wheel driven by the motor and a driven wheel coaxially arranged relative to the working tool and fixedly connected to the working tool;

wherein the tool carrier and the housing have wall sections, respectively, that overlap one another and align the tool carrier relative to the housing and the driven wheel relative to the driving wheel, when the changing unit is inserted into the housing.

2. The cleaning tool according to claim 1, wherein the housing has a receiving slot and wherein the tool carrier is insertable through the receiving slot into the housing.

3. The cleaning tool according to claim 2, wherein the tool carrier has a working slot through which the working tool extends outwardly for acting on a surface to be cleaned.

4. The cleaning tool according to claim 2, wherein the tool carrier forms a closed frame that in the mounted position is surrounded by a frame of the receiving slot substantially without play.

5. The cleaning tool according to claim 1, wherein the tool carrier has a glide plate for resting on a surface to be cleaned.

6. The cleaning tool according to claim 1, wherein the tool carrier is secured in the housing by a catch connection comprised of the catch elements, wherein the catch connection is provided in the area of the overlapping wall sections.

7. The cleaning tool according to claim 6, wherein the tool carrier has at least one projection engaging an opening on a top part of the housing.

8. The cleaning tool according to claim 7, wherein the at least one projection is positioned at a level of the catch connection and is an actuating element for releasing the catch connection.

9. The cleaning tool according to claim 1, wherein the gear system has an intermediate wheel having a peripheral area engaging the driven wheel, wherein engagement of the driven wheel and of the intermediate wheel is releasable without requiring a tool.

10. The cleaning tool according to claim 9, wherein the driving wheel and the driven wheel are V-belt pulleys, wherein the intermediate wheel is provided as a driving connection between the driving wheel and the driven wheel and is configured as a V-gear having an outer periphery engaging V-grooves of the driving and driven wheels.

11. The cleaning tool according to claim 10, wherein the outer periphery of the V-gear is elastic.

12. The cleaning tool according to claim 11, wherein the outer periphery is comprised of an elastic V-belt ring.

13. The cleaning tool according to claim 12, wherein the V-belt ring has a trapezoidal cross-section.

14. The cleaning tool according to claim 3, wherein the housing comprises a vacuum channel and a connecting socket for a vacuum pipe, wherein the vacuum channel is positioned between a bottom plate of the housing and a shaft of the drive motor, wherein a vacuum flow entering through the working slot is guided via the vacuum channel to the connecting socket.

15. The cleaning tool according to claim 14, wherein the vacuum channel is delimited by the drive motor.

16. The cleaning tool according to claim 14, wherein an exit cross-section of the vacuum channel is greater than an intake cross-section of the vacuum channel.

17. The cleaning tool according to claim 16, wherein the exit cross-section is greater than a flow cross-section of the connecting socket.

18. The cleaning tool according to claim 16, wherein the housing further comprises a collector connected between the vacuum channel and the connecting socket, wherein the collector forms a transition of the exit cross-section of the vacuum channel into the flow cross-section of the connecting socket.

19. The cleaning tool according to claim 18, wherein the collector is pivotable about a pivot axis extending transversely relative to the connecting socket in the housing.

20. The cleaning tool according to claim 19, wherein the pivot axis is arranged at an end of the collector facing away from the bottom plate.

21. The cleaning tool according to claim 18, wherein the collector comprises a guide ramp adjoining the bottom plate and bridging a vertical displacement between the vacuum channel and the connecting socket.

22. The cleaning tool according to claim 18, wherein the collector has a width in a direction of the pivot axis matching a width of the connecting socket.

23. The cleaning tool according to claim 18, wherein the connecting socket is rotatably supported in a pipe section of the collector.

* * * * *